US006216773B1

(12) United States Patent
Falta

(10) Patent No.: US 6,216,773 B1
(45) Date of Patent: Apr. 17, 2001

(54) PLATE TYPE HEAT EXCHANGE

(75) Inventor: Steven R. Falta, Ransomville, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/480,920

(22) Filed: Jan. 11, 2000

(51) Int. Cl.[7] ..... F28D 1/03
(52) U.S. Cl. ..... 165/153; 165/176
(58) Field of Search ..... 165/153, 176; 62/515

(56) References Cited

U.S. PATENT DOCUMENTS

| | | | |
|---|---|---|---|
| 4,274,482 | 6/1981 | Sonoda . | |
| 4,589,265 | 5/1986 | Nozawa . | |
| 4,712,612 | 12/1987 | Okamoto et al. . | |
| 4,775,006 | 10/1988 | Hesse . | |
| 5,024,269 | 6/1991 | Noguchi et al. | 165/153 |
| 5,042,577 | 8/1991 | Suzumura | 165/153 |
| 5,062,477 | 11/1991 | Kadle . | |
| 5,101,891 | 4/1992 | Kadle . | |
| 5,152,337 | 10/1992 | Kawakatsu et al. . | |
| 5,503,223 * | 4/1996 | Choi et al. | 165/153 |
| 5,778,974 * | 7/1998 | Kazikawa et al. | 165/153 |

FOREIGN PATENT DOCUMENTS

| | | | |
|---|---|---|---|
| 4301629 * | 7/1994 | (DE) | 165/153 |
| 3-137493 * | 6/1991 | (JP) | 165/153 |
| 3-164689 * | 7/1991 | (JP) | 165/153 |
| 6-194001 * | 7/1994 | (JP) | 62/515 |

* cited by examiner

*Primary Examiner*—Leonard Leo
(74) *Attorney, Agent, or Firm*—Patrick M. Griffin

(57) ABSTRACT

An evaporator (20) of the stacked plate, straight flow type achieves multi pass flow while locating the inlet (28) and outlet (30) adjacent to one another, without the use of embedded inlet or outlet pipes, and with only two basic plate shapes. A standard plate (32), included in all plate pairs but for the last plate pair at the far end, has a pair of identical protruding cups (34, 36), one of which (34) is open to the flow tube formed by the pair of facing plates, and the other of which, (36) is discrete from both the flow tube and the other cup (34). When stacked and aligned, the main cups (34) make up a header pipe (48) that is open to the flow tubes, one at both the top and bottom. Each header pipe (48) is adjacent to an entirely discrete transfer pipe (50). A next to last special plate (40) has an identical pair of cups (34, 36) at the bottom end, but a single, wider cross over cup (42) at the top end, which is open to the header pipe (48) and transfer pipe (50) a the top side. At the far end of the evaporator (20), the ends of both the top and bottom side header pipes (48) and transfer pipes (50) are closed off by a flat end plate (24). At the near end of the evaporator (20) the ends of the bottom side header pipe (48) and transfer (50) are closed off by a flat end plate (22), but left open at the top, to provide a refrigerant outlet (30) and inlet (28). Refrigerant entering the top side transfer pipe (50) at the near end runs to the cross over cup (42) at the far end, into the top side header pipe (48) at the far end, and then through a multi passed pattern back out the top side header pipe (48) at the near end.

5 Claims, 6 Drawing Sheets

PLATE TYPE HEAT EXCHANGE

TECHNICAL FIELD

This invention relates to vehicle air conditioning systems in general, and to a compact stacked plate type evaporator with straight flow and multi passing.

BACKGROUND OF THE INVENTION

Vehicle air conditioning systems typically use a stacked plate type evaporator, often called a laminated evaporator in published patents. A common feature of such designs is integral flow tubes and headers made of aligned pairs of stamped plates. Each plate of each complete pair is generally rectangular, or at least longer than wide, and has an inner surface that faces the inner surface of the other plate, sealed together by brazing to create a thin, wide flow tube between the inner surfaces. The inner plate surfaces are often enhanced with bumps that braze to opposed bumps on the facing plate, strengthening the tube formed by the plate pair. Integrally stamped at the ends of the plates are open, protruding cups, typically one cup at each end, or two side by side cups at one end, which protrude away from the outer surface of the plates and are open to the inner surface of the plates. When the plate pairs (flow tubes) are stacked together to assemble the generally box shaped evaporator, the pairs of oppositely protruding cups align to create header pipes, either one pipe on each side of the heat exchanger (straight flow) or two adjacent pipes on one side (so called U flow). The two endmost plate pairs are generally are not complete pairs, that is, do not contain two identical stamped plates. Instead, the end plate of the first and last plate pairs is often simply flat, or at least has its cups closed off. This is because the two end plates simply provide end closures and/or a mounting surface for the inlet and outlet. The stacked cups of the complete plate pairs also act to space out the plate pairs to provide space for corrugated air cooling fins.

A continuing problem in the art of stacked, plate type evaporators has been the need for a compact arrangement of the regfrigerant inlet and outlet lines. That is, the ideal configuration is to have the inlet line to the inlet header and the outlet line from the outlet header directly adjacent, on just one side and the same end of the evaporator, at the same corner of the box, in effect. This is compact and easy to connect or disconnect from the rest of the system. This ideal is especially difficult to achieve, however, with the straight flow design, in which the header pipes are on opposite sides of the evaporator, running along the top and bottom of the box. With such a design, as illustrated in FIG. 5 of U.S. Pat. No. 5,101,891, the simplest configuration is one in which a short inlet line or fitting is fixed to the header pipe on one end and one side of the evaporator, and the outlet line is a short fitting diagonally opposed thereto, at the other side and other end. A long cross over pipe running outside of the evaporator would be needed to make the two fittings adjacent, at the same end and side.

Another continuing problem with the type of evaporator just described has been the need to distribute the refrigerant flow evenly throughout the evaporator, overcoming the natural tendency of the refrigerant to flow in a path of least resistance diagonally across the core from inlet to outlet, while not completely filling the other two comers of the core. This has been solved by so called multi passing of the flow, providing one or more barriers or separators in the header pipes to force the flow into a back and forth pattern, evenly distributed throughout the whole evaporator. With stamped plates, the separators can be conveniently and inexpensively providing by simply not punching the central hole in those plate cups where a flow barrier is desired. This, in turn, can be easily achieved just by retracting the punch that would normally pierce the stamped cup. A different or special stamping die is not needed to manufacture the barrier plate. An example of such a multi passed design can be seen in U.S. Pat. No. 4,274,482.

One embodiment in the just mentioned 4,724,482 patent illustrates the difficulty in providing compact inlets and outlets with a straight low design. The best that is achieved is to place the inlet and outlet fitting on the same end, but not the same side, of the evaporator, as illustrated in FIG. 5. But to do so, an embedded inlet pipe must be inserted down into one header, the embedded end of which must be sealed to a cup deep within the core, which is difficult to control. An alternate, multi passed, straight flow stacked plate evaporator design shown in U.S. Pat. No. 4,712,612 does not use an embedded inlet pipe, but again relies on long, external pipes to bring the otherwise distant inlet and outlet fittings adjacent to one another.

The so called U flow plate design, a typical example of which can be seen in U.S. Pat. No. 5,062,477, has the header pipes or tanks on the same side (top or bottom) of the box, but the simplest flow pattern still results in the inlet and outlet being on opposite ends of the evaporator, as shown in FIG. 1 thereof. Providing more complex, multi passed flow patterns in a U flow evaporator, while still placing the inlet and outlet fittings directly adjacent to one another is more complicated. Several examples of such in a U flow evaporator can be seen in U.S. Pat. No. 5,024,269. There, a combination of embedded inlet/outlet pipes and several different stamped plate shapes are used within each embodiment to achieve the desired end result. Neither embedded pipes nor a multiplicity of stamped plate shapes is desirable from a cost and ease of assembly standpoint. The U flow design shown in U.S. Pat. No. 4,589,265 puts the inlet and outlet fitting adjacent and avoids using embedded inlet or outlet pipes by incorporating that function into the drawn cups of some of the plates. Basically, the entire core is divided in half by two different types of complete plate pairs, and a complex flow pattern is created within the core that runs first in a U pattern from the near to the far end, then side to side (bottom to top) in another U pattern, and finally back from the far end to the near end. Again, a complex, U type flow pattern and several different plate designs are used just to locate the inlet and outlet in the desired location. More generally, U flow designs per se are undesirable when the core itself is shallow and each plate pair is narrow. Dividing an already narrow plate pair with the central rib necessary to give the characteristic U flow pattern creates even narrower flow paths and too large a pressure drop.

SUMMARY OF THE INVENTION

A plate type heat exchanger according to the subject invention is characterized by the features specified in Claim 1.

In general, the stacked plate design of the invention provides a multi passed design with straight, rather than U flow and compact inlet and outlet, without the use of embedded inlet or outlet pipes, and with a minimum of different plate shapes. One basic or standard plate shape provides all of the plate pairs of the basic core, but for the plate pair at the far end. The inlet and outlet can be located at the same comer of the evaporator with a minimum of manufacturing complexity, while providing a standard, multi pass flow path.

In the embodiment disclosed, the standard plate shape includes a pair of side by side protruding cups at each end, four total, of which only three are actually utilized in the final assembled evaporator. However, making each end of the standard plate identical preserves symmetry and manufacturing simplicity. The first or main cup of each pair is open to the inner surface of the plate, while the second is not, and is also discrete from the first cup. The standard plates can be joined in face to face pairs to create flow tubes, in typical fashion, because of their end to end symmetry. When a plurality of such plate pairs are stacked together, the aligned main cups create a header pipe on each side (or top and bottom) of the evaporator. Adjacent to each header pipe is a discrete transfer pipe, formed by the aligned second cups.

At the far end of the evaporator, the next to last plate is a special plate which, unlike the standard plates, is not symmetrical end to end. One end (bottom end) has the same first and second cup pair as the standard plate design, while the other end (top end) has a single, inwardly protruding cross over cup, which is open to the ends of both the top side header pipe and transfer pipe. In addition, at least one standard plate has its main cup unpierced at the upper end, so as to block at least the top side header pipe at a point intermediate the near and far ends of the evaporator. At both the near and far end of the evaporator, a flat plate serves to close off the transfer pipes and header pipes at their ends, except at the top side of the near end, which is left open.

The evaporator core so constructed allows for refrigerant to enter the open transfer pipe at the top side, near end. The inlet refrigerant flows through the discrete transfer pipe along the top side, all the way to the far end, without entering any of the flow tubes. At the far end, the refrigerant flows through the cross over cup, into the adjacent header pipe on the top side, where its flow is blocked by the at least one separator. Flow is thus forced down through those flow tubes (plate pairs) that are located between the separator and the far end. From there, refrigerant flows through the bottom side header pipe and ultimately against the closure provided by the near end outer flat plate, which forces it back up into the top side header pipe and out the open end of the top side header pipe, adjacent to the inlet point. The transfer pipe at the bottom side of the evaporator completely closed off at each end by the two end plates, and thus rendered non functional. However, this empty space is not a draw back, since it is the end to end plate symmetry provided by the identical two pairs of cups that provides the manufacturing and assembly advantage. The non used space can also be minimized by making the second cup narrower than the first, maximizing the size of the header pipe compared to the transfer pipe. So a simple, compact design is achieved with a minimum of different plate designs and part inventory.

BRIEF DESCRIPTION OF THE DRAWINGS

These and other features of the invention will appear from the following written description, and from the drawings, in which.

DESCRIPTION OF THE PREFERRED EMBODIMENT

Figure 1:
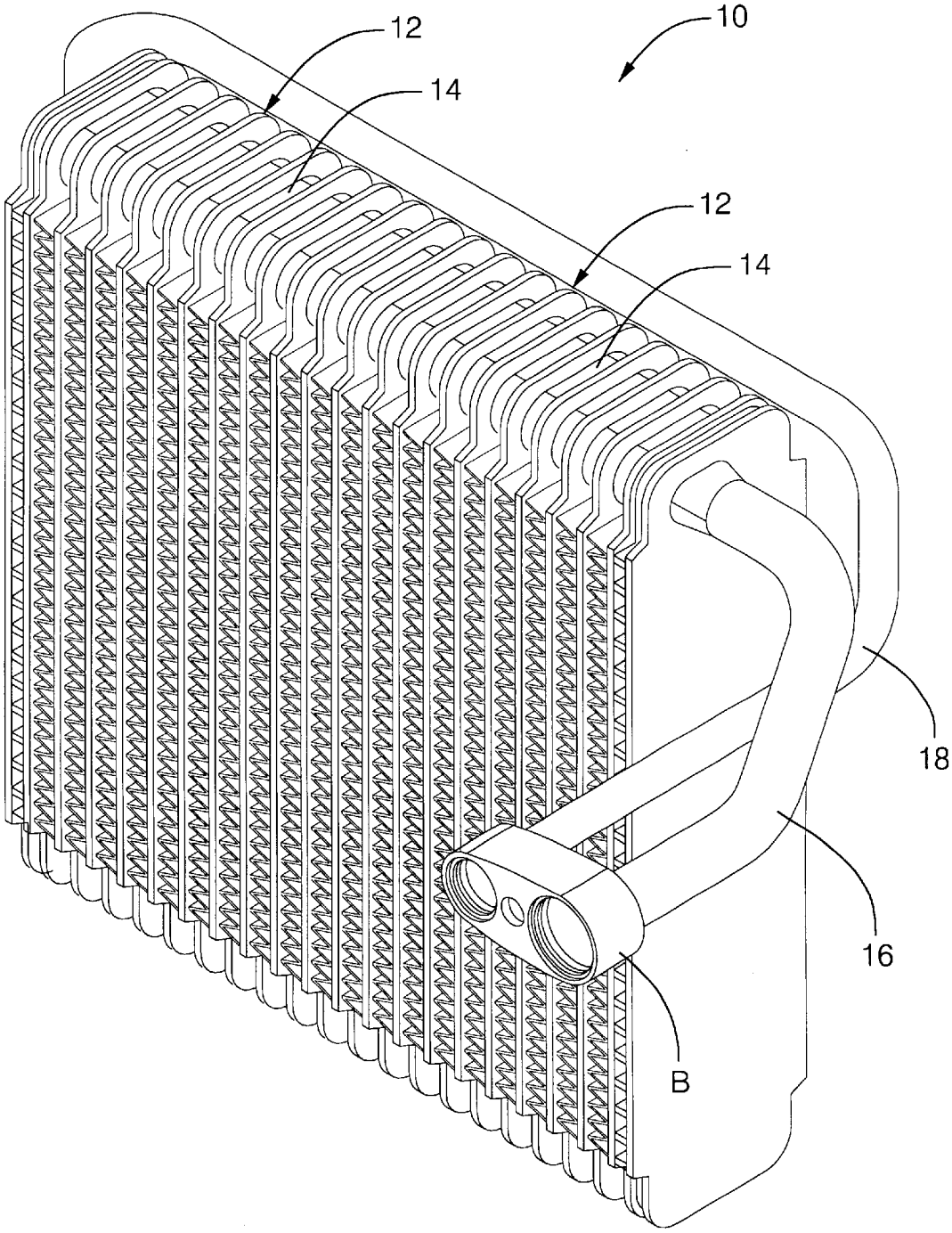
PRIOR ART FIG. 1
FIG. 1 is a perspective view of a prior art evaporator.

Referring first to FIG. 1, a prior art evaporator of the stacked plate, laminated type, with straight flow, is indicated generally at 10. Evaporator 10 is comprised of a plurality of plate pairs 12, each plate of which has a single, wide protruding cup 14 at each end. The cups 14 align and stack up to create header pipes along the top and bottom side of the evaporator 10. In order to bring the inlet line 16 and outlet line 18 back to a common point at a block fitting B at the near end of the evaporator 10, it is necessary that one of the lines be run externally, from the bottom side of the far end, up the far end and along the top side back to the far end. This is expensive and space consuming. The external running line can be replaced with an embedded line, as noted above, but this necessitates an internal braze joint that is difficult to control.

Figure 2:
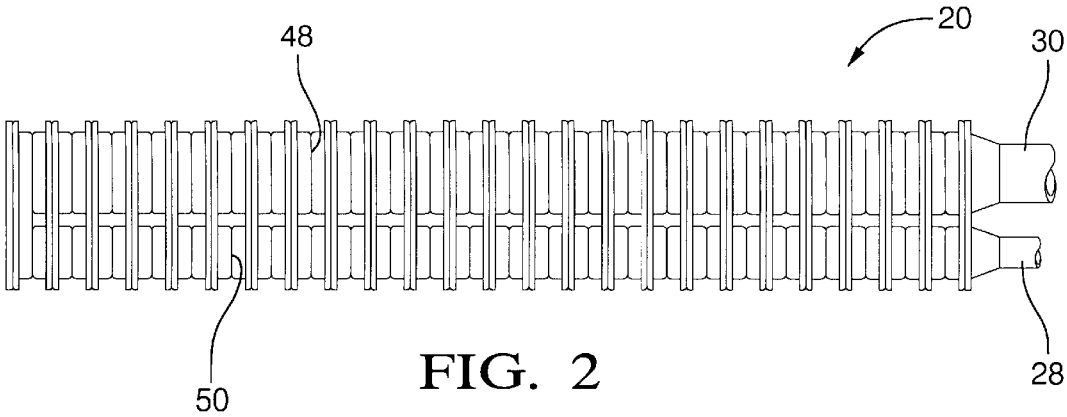
FIG. 2 is a top side view of a preferred embodiment of an evaporator according to the invention.
Figure 3:
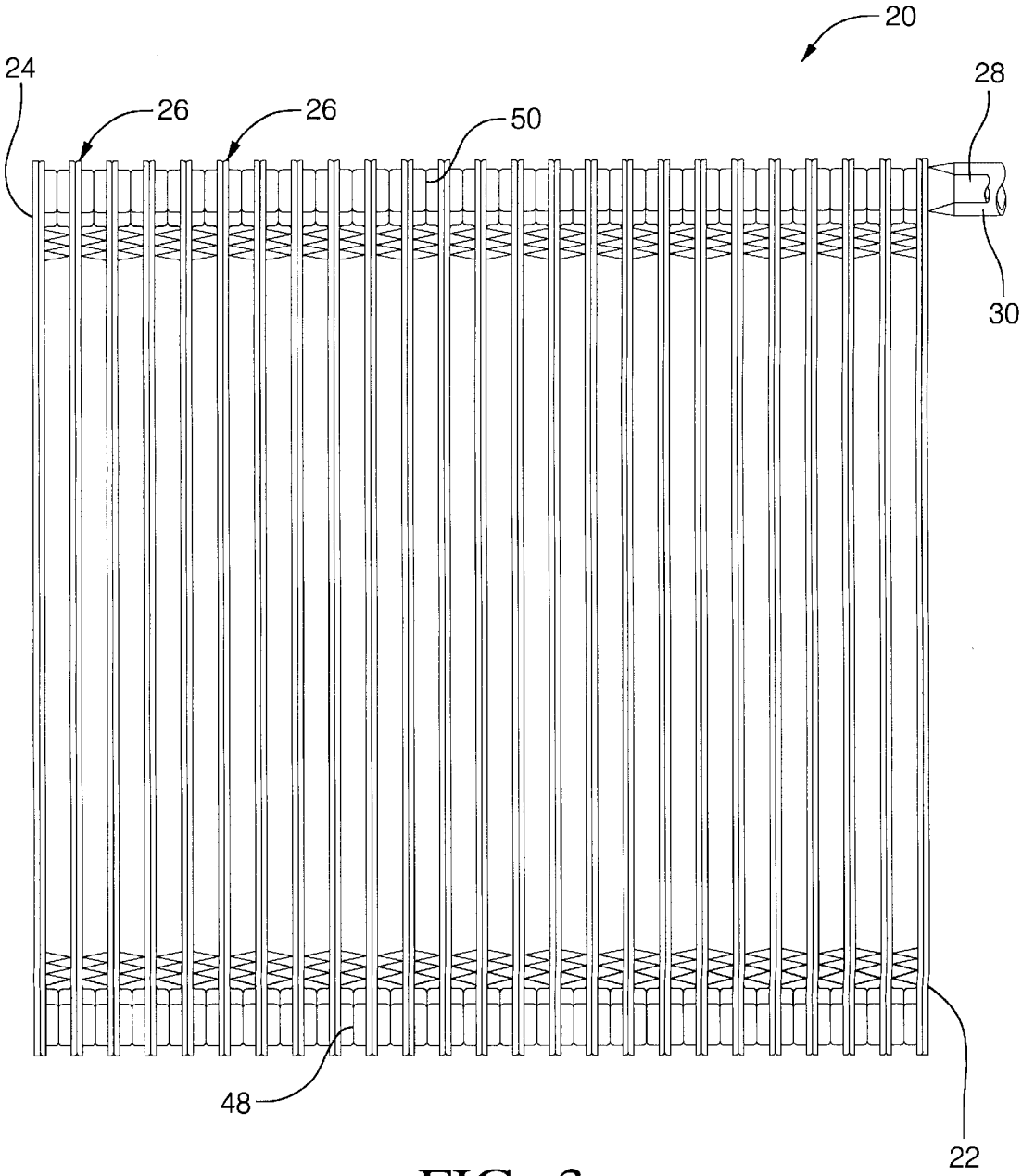
FIG. 3 is a front view of the same evaporator.

Referring next to FIGS. 2 and 3, a preferred embodiment of an evaporator according to the invention is indicated generally at 20 Evaporator 20 is also generally box shaped, with a near end flat plate 22, a far end flat plate 24, and plurality of complete or standard plate pairs in between, indicated generally at 26. Evaporator 20 is the straight flow type, that is, each plate pair 26 is a fabricated flow tube, and refrigerant flows across the entire width. This presents a smaller pressure drop than a U flow design, which uses only half the plate width, especially with a shallow or narrow core. However, the invention provides an inlet 28 and outlet 30, both short fittings rather than long lines, that are adjacent. By adjacent, it is meant that they are at the same corner, at the top side and near end of the evaporator 20. There are no long external lines, and no embedded pipes behind the fittings 28 and 30. This is made possible by the particular plate designs and shapes described in detail next.

Figure 4:
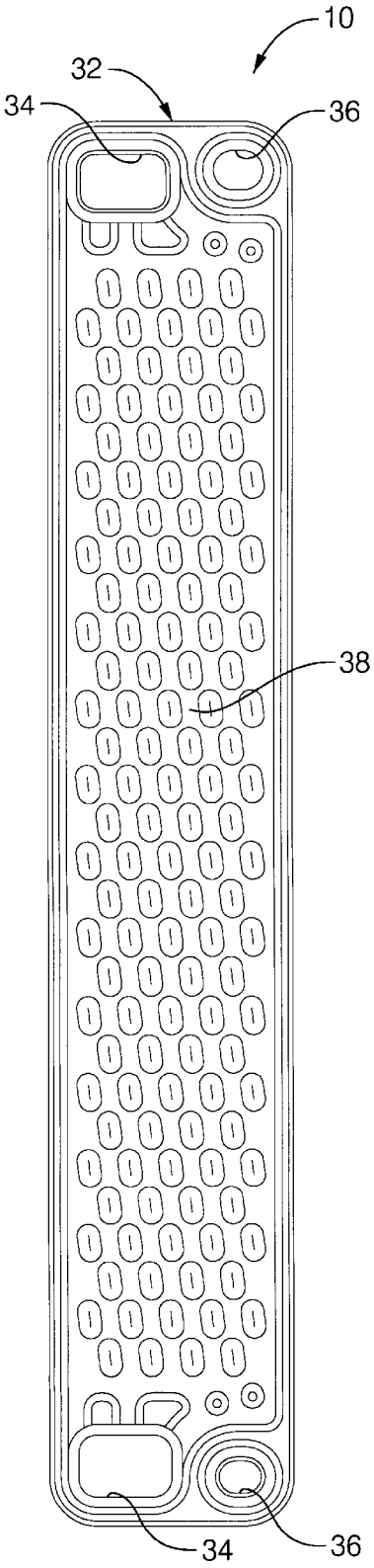
FIG. 4 is a plan view of the inner surface of a standard plate.
Figure 8:
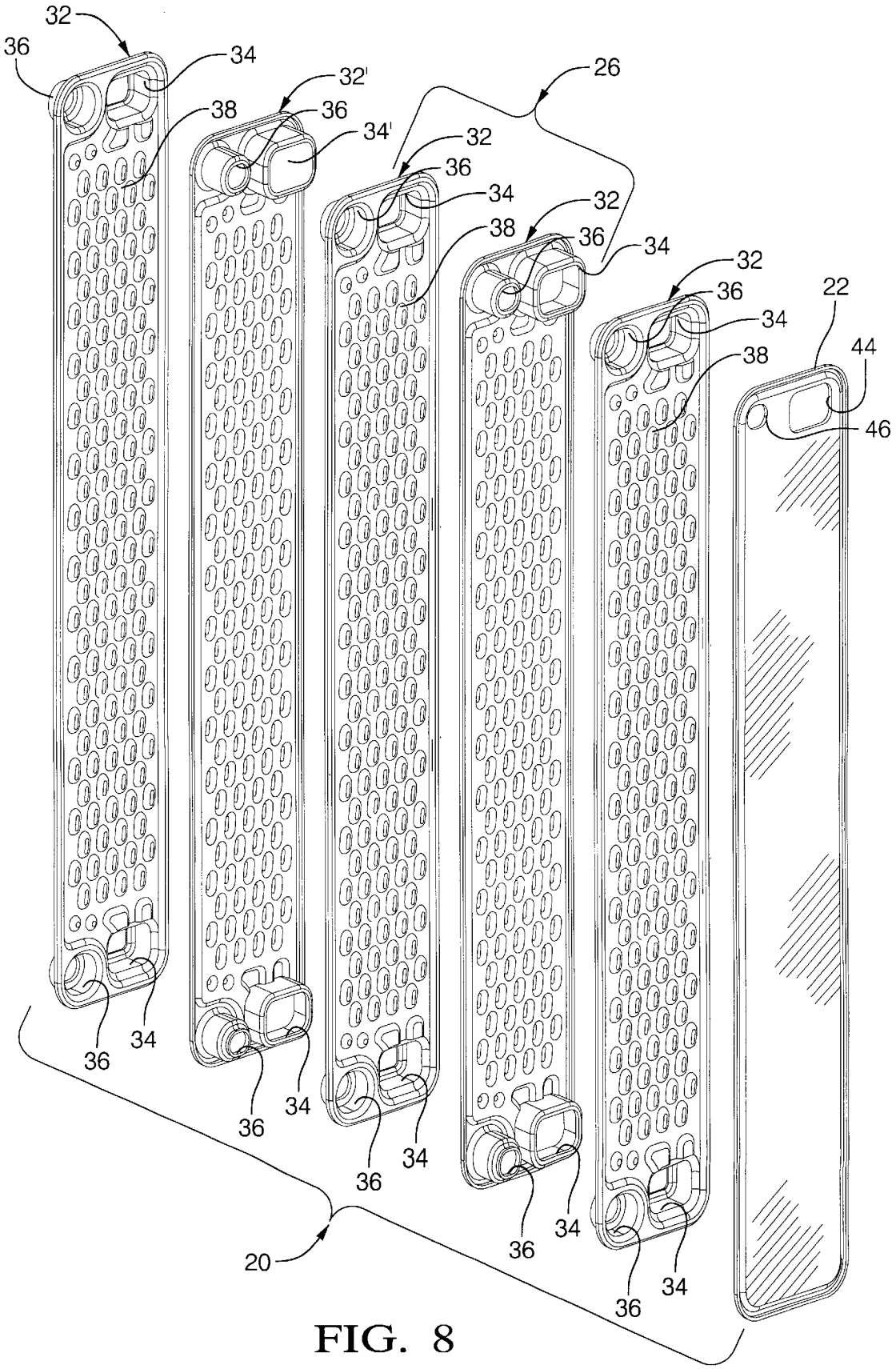
FIG. 8 is a perspective view showing a standard plate next to a standard plate modified to provide flow separation, an adjacent facing pair of standard plates, and another standard plate adjacent to the near end flat plate.

Referring next to FIGS. 4 and 8, the complete or standard plate pairs 26 noted above consist of a facing pair of identical, standard stamped plates, one of which is indicated generally at 32, and several of which are shown in FIG. 8. By "complete," it is meant that each plate pair 26, but for the endmost two pairs, includes two of the standard plates 32, whereas the endmost two plate pairs do not, as described in more detail below. Each standard plate 32 has a pair of cups at each end, a first or main cup 34, and an adjacent second cup 36. Each cup 34 and 36 protrudes the same distance from the plate inner surface 38, and each is pierced or open at the center. The main cup 34 is wider, however, and is open to the plate inner surface 38, while the second cup 36 is narrower, and is formed so as to be discrete, both from the main cup 34 and the plate inner surface 38. This end to end symmetry allows two of the standard plates 32 to be sandwiched together with inner surfaces 38 facing, as best seen in FIG. 8, and with the respective pairs of cups 34 and 36 aligned, but protruding in opposite directions. When the rims around the inner surfaces 38 are brazed together, flow tubes are formed by the resulting plate pair 26, and refrigerant can flow from one main cup 34 and up or down to the other main cup 34. While the main cup 34 is not full width of the plate 32, it is wide enough to successfully distribute or drain refrigerant from the flow space formed between the facing inner surfaces 38.

Figure 6:
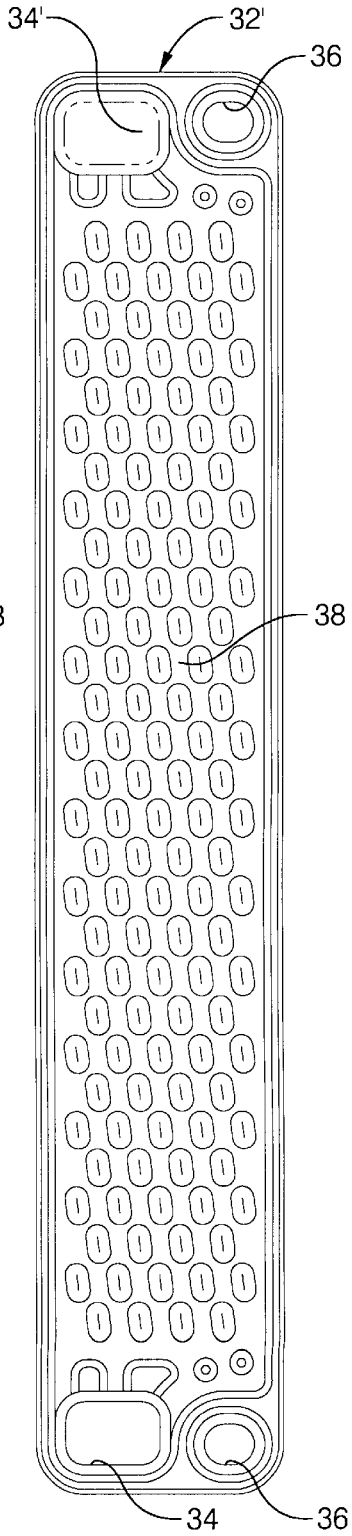
FIG. 6 is a plan view of the inner surface of a standard plate modified to provide a flow separator.

Referring next to FIGS. 6 and 8, all of the complete plate pairs 26 are formed from plates exactly like standard plate 32, with one minor, but operationally significant, exception. At at least one point the core, (at three points in the embodiment disclosed), one of the standard plates, indicated at 32', is stamped so as to leave the main cup 34' at one end unpierced and solid. Modified standard plate 32' is the same size and shape, and stamped with the same die set, so that the remaining cups 34 and 36 are identical to a non modified standard plate 32. One cup piercing punch in the die is simply left retracted when the stamping operation is carried out. Thus, no extra dies are needed, and the modified plate 32' does not really represent an extra expense, or even a different plate design, as such.

Figure 5:
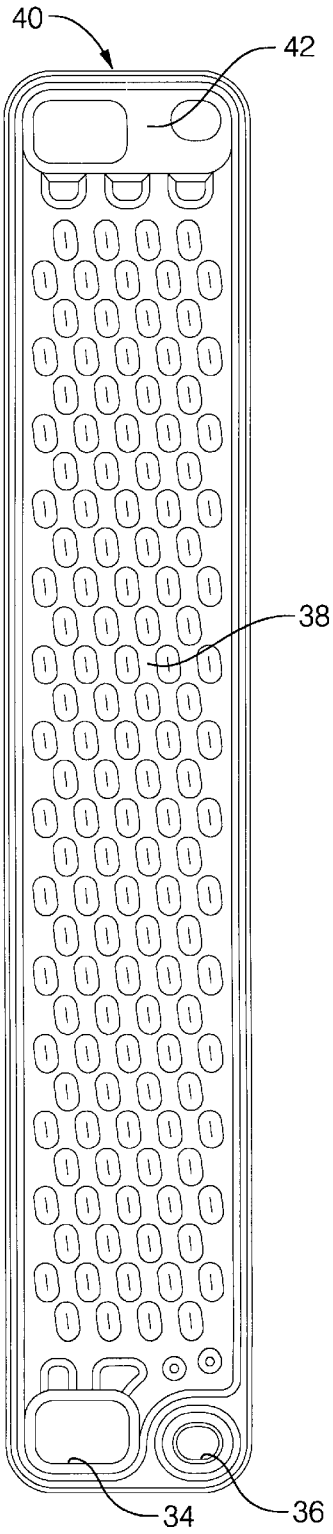
FIG. 5 is a plan view of the inner surface of a special plate.
Figure 7:
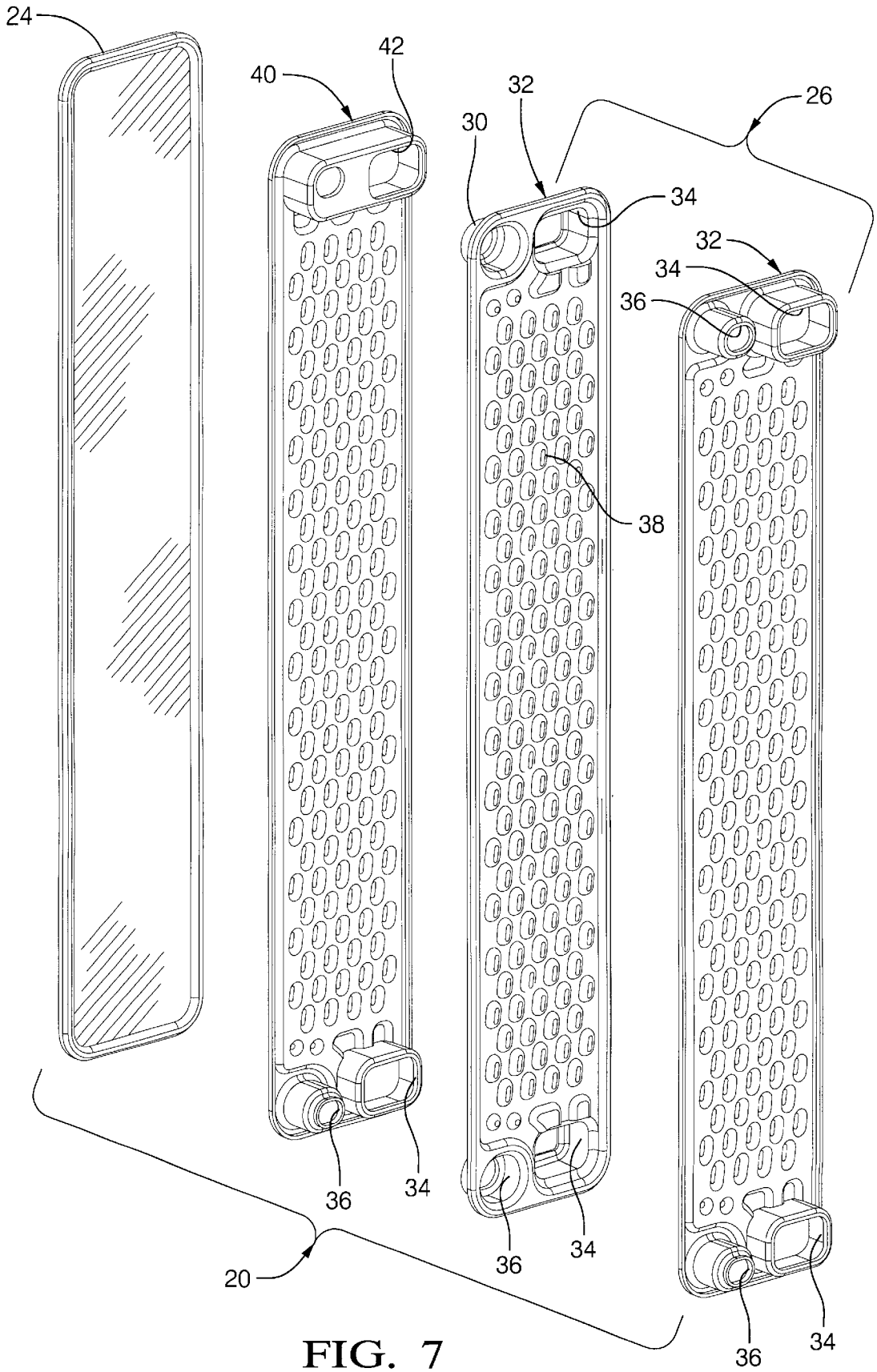
FIG. 7 is a perspective view showing the far end flat plate, adjacent special plate, and a facing pair of standard plates.

Referring next to FIGS. 5 and 7, the plate design that does differ significantly from standard plate 32 is a so called special plate, indicated generally at 40. Special plate 40 is the same size and basic shape as standard plate 32, with adjacent cups 34 and 36 at one end identical to the like numbered cups on a standard plate 32, and an identical inner surface 38. The special plate 40 is not end to end symmetrical, however, having a single large cross over cup 42 at the other end. Cross over cup 42 also protrudes from the inner surface 38, and is approximately the same size as an adjacent pair of cups 34 and 36, and double pierced to match them. However, the cross over cup 42 is a single cup that is entirely open to the plate inner surface 38, not two cups, one of which is discrete. Only one special plate 40 is used, and its location and operation are described next.

Referring next to FIGS. 2, 7 and 8, the general assembly of evaporator 20, and the location of the various plate designs, are illustrated. All of the plate pairs 26 are sandwiched between the two end plates, the near end flat plate 22 and far end flat plate 24. The term "flat" here does not necessarily mean absolutely flat, though the end plates could be, but flat in the sense that no protruding cups are needed. The end plates 22 and 24 simply provide closure of the two plates that are directly adjacent thereto. The far end plate 24 is a simple closure, paired with the adjacent special plate 40. The near end plate 22 is paired with the adjacent standard plate 32, and is pierced at 44 and 46 to provide entry into the aligned cups 34 and 36 of the adjacent standard plate 32. When evaporator 20 is stacked for brazing, all of the oppositely protruding cups 34 and 36 of the standard plate pairs 26 align to create a header pipe 48 and side by side transfer pipe 50 respectively. There are an adjacent pair of header pipes 48 and 50 at both the top and bottom sides of the evaporator 20, but only three of these possible four flow passages are operational, as described below. At one side (the top side), header pipe 48 and transfer pipe 50 are open, at the near end, to the outlet fitting 30 and inlet fitting 28 respectively. These are brazed to the near end flat plate 22 at its two pierced holes 44 and 46. At a select number of locations along the plate stack, a modified standard plate 32' is inserted, with an unpierced main cup 34' located either in the top or bottom side header pipe 48. The number of such blocking locations depends on the number of desired flow passes, as described in more detail below, but at least one such unpierced main cup 34' would be placed at the top side, blocking the top side header pipe 48, as shown in FIG. 8. In general, then, only two basic plate designs are needed, apart from the closure providing end plates 22 and 24, these being the standard plate 32 (and 32'), and the special plate 40. Only two different die sets are needed to make these two basic plates, minimizing tooling and cost. Only one special plate 40 is needed, and that is found in a fixed, easily accounted for location, adjacent to the far end plate 24. Assembly is, therefore, inexpensive and relatively simple, with no embedded inlet or outlet pipes, and very few different plate designs or locations.

Figure 9:
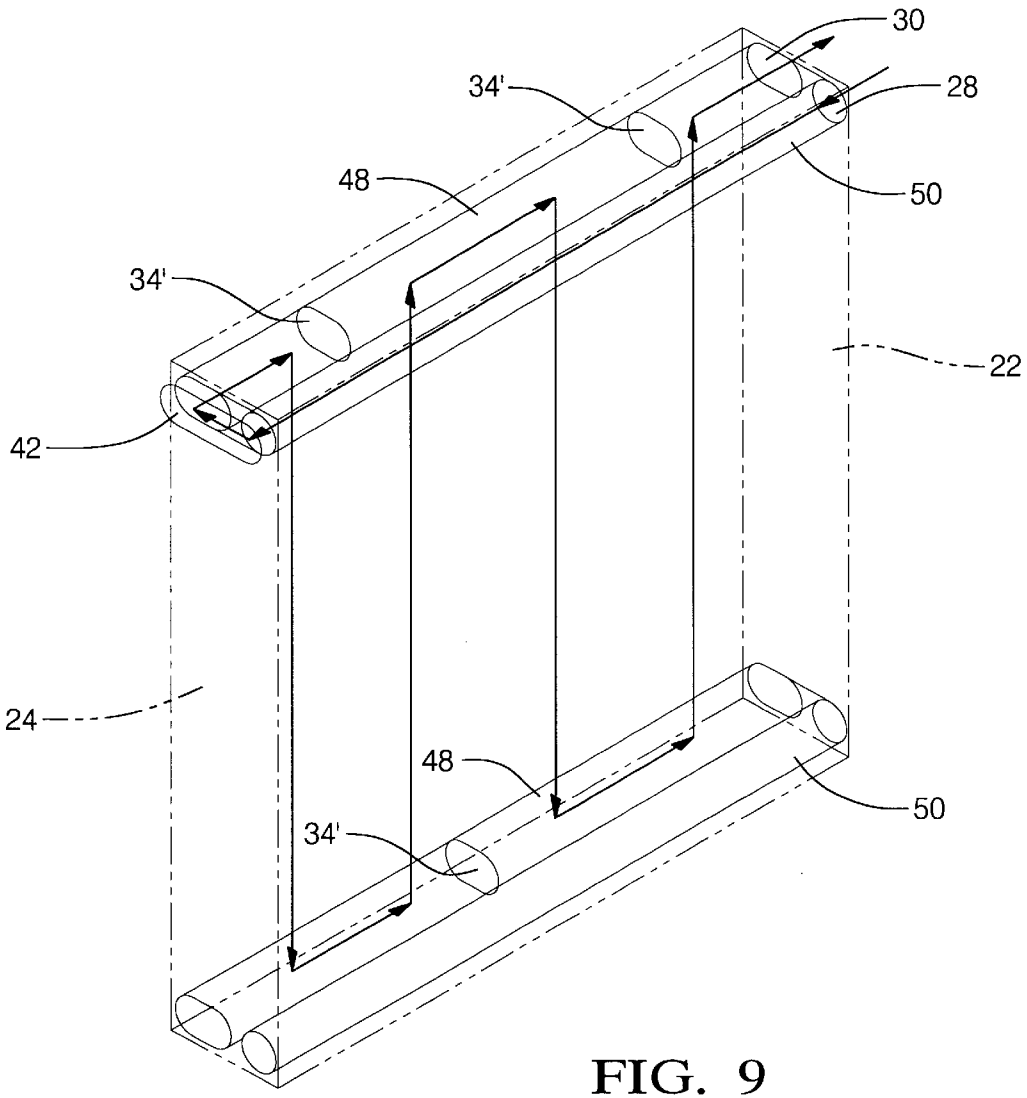
FIG. 9 is a schematic perspective view of one possible multi pass flow pattern achievable with the invention.

Referring next to FIG. 9, the flow operation possible with this simple design is illustrated. As disclosed, three modified standard plates 32' with unpierced cups 34' are staggered along the core, two in the top side header pipe 48, and one in the bottom side header pipe 48, between the other two. The number of modified standard plates used will determine the number of flow passes. That is, a single one in the top header pipe 48 will give a two pass pattern, one more in the bottom header pipe 48 will give three passes, yet one more in the top header pipe 48 will give four, or one for two, two for three, three for four, and so on. In the embodiment disclosed, a four pass pattern is used, illustrated in simplified fashion. As shown, refrigerant from the inlet fitting enters the top side transfer pipe 50 at the near end and flows all the way to the far end without entering any of the plate pairs 26, since the aligned second cups 36 are all discrete. At the far end, the refrigerant flow enters the cross over cup 42 of the special plate 40, flows into the adjacent top side header pipe 48, and then is forced downwardly by the top side flow separator 34', through those standard plate pairs 26 located between the top side flow separator 34' and the far end plate 24, and into the bottom side header pipe 48. This completes a first pass. Next, refrigerant flow follows the bottom side header pipe 48 until blocked by the bottom side flow separator 34', where it is forced up, into the top side header pipe 48 again, completing a second pass. From the top side header pipe 48, flow is forced down and up again in two more passes, ultimately exiting the top side header pipe 48 through the outlet fitting 30. The terms top and bottom, near and far, should be understood to be terms of convenience, here, since evaporator 20 could be reversed. What is significant is that the inlet and outlet fittings 28 and 30 are adjacent, at the same end and same side of evaporator 20, whether that side is top or bottom, or near or far. This is the most compact arrangement possible. This compact arrangement is achieved even though the flow pattern is straight, not U flow, and even though no embedded inlet or outlet pipes are utilized. The inlet and outlet could be reversed, as well, and would still run in a straight flow, multi pass pattern with adjacent inlet and outlet. Regardless, the transfer pipe 50 that is opposite the side with the adjacent inlet and outlet is non utilized, closed off between the end plates 22 and 24, and dry. While a single line of cups and single header pipe at that side could be provided, doing so would disrupt the end to end symmetry of the otherwise standardized plate 32. Breaking that symmetry would require that mirrored, right and left hand plates be stamped, with different die sets, to make up the plate pairs. So, the seemingly extra and useless space provides a real advantage, both eliminating the need for an embedded inlet pipe and minimizing the number of plate shapes needed.

Variations in the disclosed embodiment could be made. Most generally, the design shown could be used as a heat exchanger other than an evaporator, such as a heater core. As already noted, more or fewer passes could be provided with more or fewer modified standard plates 32'. Even greater standardization of plates could be provided by replacing the far end flat plate 24 with a further modified standard plate 32 in which all of the cups 34 and 36 at both plate ends were left closed, so that it would provide a complete closure to the adjacent special plate 40. Likewise, the near end flat plate 22 could be replaced with a modified standard plate 32 in which just the cups 34 and 36 at one end were left closed. The inlet and outlet fittings 28 and 30 could be attached to the pierced cups 34 and 36 at the other end. Doing this would eliminate whatever tooling was needed to create the flat end plates. Generally, however, it is desired to have the end plates essentially flat, with no protrusions, such as un pierced protruding cups would create. The special plate cross over cup 42 need not absolutely be open to the inner surface 38 of that plate, and could be discrete therefrom. So long as the cross over cup 42 is open to the cup pair 34 and 36 of the adjacent standard plate 32, it will still act to send the flow from the transfer pipe 50 into the header pipe 48. But, unless the transfer cup 42 is also open to the inner surface 38 of the special plate 40, the flow tube otherwise created by special plate 40 and the far end plate 24 will not have moving flow through it. The main cup (34) is disclosed as being wider than the discrete second cup (36), since it is the cup that makes up the tube feeding header pipe (48), as opposed to the discrete transfer pipe (50), which does not feed the flow tubes. That relative width relationship is not absolutely necessary, but is helpful. Therefore, it will be understood that it is not intended to limit the invention to just the preferred embodiment disclosed.

What is claimed is:

1. A heat exchanger (20) having a plurality of flow tubes through which a fluid flows, each flow tube formed by the facing inner surfaces (38) of a pair of generally stamped plates (32), with the plate pairs (26) stacked together in a generally box shaped configuration, characterized in that, each stamped plate (32) of each complete plate pair (26) includes an identical adjacent pair of protruding stamped cups (34, 36) at each end thereof, with a first cup (34) of each pair being open to the inner surface (38) of said plate (32) and a second cup (36) of each pair being discrete both from the first cup (34) and from the plate inner surface (38), so that as the complete plate pairs (26) are stacked together, a header pipe (48) is formed on each side of the heat exchanger (20) adjacent to a discrete transfer pipe (50), a last plate pair (24, 40) at the far end of the heat exchanger includes a special plate (40) having a single protruding stamped cross over cup (42) on one side of said heat exchanger open to the first (34) and second (36) stamped cups of the adjacent stamped plate (32) and a pair of protruding stamped cups (34', 36') at the other side of said heat exchanger (20) identical to the first (34) and second stamped cups (36), at least one flow separator (34') is located in the header pipe (48) on said side of said heat exchanger (20) at a location between the near and far end thereof, and, means (22, 24) at the near and far end of the heat exchanger (20) that blocks both ends of the header pipe (48) and transfer pipe (50) on the other side of said heat exchanger (20) and leaves the header pipe (48) and transfer pipe (50) open only on said one side of the near end of said heat exchanger (20), whereby the fluid flow enters or exits the open discrete transfer pipe (50) located on said one side of the heat exchanger (20) at the heat exchanger near end and flows to the heat exchanger far end, flows through the cross over cup (42) and into the header pipe (48) on said one side of the heat exchanger (20), against said at least one flow separator (34'), through the flow tubes located between said far end and separator (34') and into the header pipe (48) on the other side of the heat exchanger (20), without entering the adjacent transfer pipe (48) on said other side of said heater exchanger (20), and then back through the flow tubes located between said separator (34') and the near end of said heat exchanger (20), back into the header pipe (48) on said one side of the heat exchanger (20) and then exits or enters the heat exchanger (20) back at said one side of the heat exchanger (20) near end.

2. A heat exchanger according to claim 1, further characterized in that the cross over cup (42) is open to the inner surface (38) of said special plate (40).

3. A heat exchanger according to claim 1, further characterized in that the cross over cup (42) is at the top side of the heat exchanger (20), the fluid enters the transfer pipe (5) at the top side of the heat exchanger (20) and exits the header pipe (48) at the top side of the heat exchanger (20).

4. A heat exchanger according to claim 3, further characterized in that heat exchanger (20) is an evaporator, and the fluid is a refrigerant.

5. A heat exchanger according to claim 4, further characterized in that the means (22, 24) are flat plates and the near and far end of the heat exchanger (20).

* * * * *